US007273076B2

(12) United States Patent
Franck

(10) Patent No.: US 7,273,076 B2
(45) Date of Patent: Sep. 25, 2007

(54) DEVICE FOR EMPTYING A PRESSURE CONTAINER

(75) Inventor: Michael Franck, Lübeck (DE)

(73) Assignee: Umwelt-Technik-Metallrecycling GmbH, Lübeck (DE)

( * ) Notice: Subject to any disclaimer, the term of this patent is extended or adjusted under 35 U.S.C. 154(b) by 104 days.

(21) Appl. No.: 11/181,422

(22) Filed: Jul. 14, 2005

(65) Prior Publication Data

US 2006/0011255 A1 Jan. 19, 2006

(30) Foreign Application Priority Data

Jul. 16, 2004 (EP) ..... 04016805

(51) Int. Cl.
*B65B 1/04* (2006.01)

(52) U.S. Cl. ..... 141/65; 141/329; 222/81

(58) Field of Classification Search ..... 141/65, 141/66, 51, 98, 1, 329, 330, 82; 588/259, 588/260; 222/83, 83.5, 81, 87, 88
See application file for complete search history.

(56) References Cited

U.S. PATENT DOCUMENTS

| | | | | |
|---|---|---|---|---|
| 4,690,180 | A | 9/1987 | Gold | |
| 5,607,384 | A | 3/1997 | Caparros | |
| 5,901,759 | A * | 5/1999 | Nickens et al. | 141/51 |
| 5,957,168 | A | 9/1999 | Nickens et al. | |
| 6,308,748 | B1 | 10/2001 | Nickens et al. | |

FOREIGN PATENT DOCUMENTS

| | | |
|---|---|---|
| DE | 90 15 790 U1 | 4/1991 |
| FR | 2 565 664 A1 | 12/1985 |

* cited by examiner

*Primary Examiner*—Steven O. Douglas
(74) *Attorney, Agent, or Firm*—Akin Gump Strauss Hauer & Feld LLP

(57) ABSTRACT

A device is provided for emptying a pressure container (4) which includes a receptacle (2) capable of being closed in a pressure-tight manner, for accommodating the pressure container (4), means for opening (38) the pressure container (4) located in the receptacle (2), means for leading away the container contents, and an excess pressure safety means.

15 Claims, 5 Drawing Sheets

DEVICE FOR EMPTYING A PRESSURE CONTAINER

BACKGROUND OF THE INVENTION

The invention relates to a device for emptying a pressure container.

The residual contents of old pressure containers which have been used for the storage of compressed, liquefied gases or gases dissolved under pressure may represent a significant safety risk to people and environment. This is particularly the case if combustible or toxic substances have been stored in the pressure containers. Also pressure containers which have been exposed to a corrosive environment over a longer period of time, or have become damaged, represent a potential danger which is to be taken very seriously.

For this reason it is necessary to empty the pressure containers in a safe and technically correct way and manner. This is particularly difficult if the outlet valve of the pressure container may not be released or is damaged. In this case, the pressure container must be opened by way of drilling open its wall, where upon one must prevent the contents of the container from being set free in an uncontrolled manner. This entails significant difficulties.

BRIEF SUMMARY OF THE INVENTION

Against this background, it is the object of the present invention to provide a device for emptying a pressure container which permits the above-described pressure container to be opened without endangering the personnel operating the device, as well as the environment on account of exiting substances or due to a bursting of the pressure container.

According to the invention, this object is achieved by a device which comprises a receptacle for accommodating the pressure container, the receptacle being capable of being closed in a pressure-tight manner, means for opening the pressure container located in the receptacle, means for leading away the container contents and an excess pressure safety means.

The basic concept of the present invention is to open the pressure container in a receptacle capable of being closed in a pressure-tight manner in order to ensure that the substance located in the pressure container does not reach the surroundings after opening. When the pressure container is opened, the substance which is then located within the receptacle may be led away in a targeted manner via conduits, and disposed of. As a precaution however there is an excess safety pressure means in the case that an excess pressure arises within the receptacle on opening the pressure container, which lies above the allowable gas pressure due to conditions which are not to be completely ruled out. In order in this case to ensure that the receptacle is not torn apart by way of the in particular sudden increase in pressure, according to the invention an excess pressure safety means is provided which as the case may be, and also for a short time, releases large opening cross sections in order to reliably prevent a bursting of the receptacle. At the same time it is to be understood that this bursting pressure is designed adequately high, for example is 500 bar, so that the excess pressure safety means only becomes active as a last emergency safety measure in order then to prevent greater damage.

A tool is arranged in the inside of the receptacle, with which a pressure container stored in the receptacle may be opened. This arrangement permits the opening of the pressure container in the inner space of the receptacle which is closed in a pressure-tight manner, so that the contents of the pressure container during and after its opening may be collected from the receptacle and may not escape into the environment. This is particularly useful if the exact content of the pressure container, with which it is generally the case of gases and liquids, are unknown, since thus at all events one may prevent a contamination of the operating personnel and the environment by dangerous substances which may be possibly stored in the pressure container.

An analysis of the container contents may be effected after opening the pressure container, and specifically in the receptacle itself, by way of advantageously arranging suitable sensor means which detect the type of the substance stored in the pressure container, as well as preferably outside the receptacle after leading away the container contents by way of means on the device which are provided for this, such as conduits, pumps valves and the like.

An excess pressure safety means is provided on the device, since the degree of filling and thus the pressure condition of the pressure container which this entails is not always known. This excess pressure safety means prevents an excess pressure which may build up in the receptacle after opening the pressure container from leading to a destruction of the device and to an endangering of the operating personnel. On reaching a certain pressure level in the receptacle, the excess pressure safety means permits a controlled pressure relief by way of pressure compensation with the surroundings. The excess pressure safety means may for example be realized by the use of pressure relief valves or bursting disks, but preferably according to the invention a pressure-compensating design of the receptacle is envisaged.

For this, the receptacle is usefully designed at least of two parts, wherein at least two parts of the receptacle are braced to one another for forming the excess pressure safety means.

The bracing is designed such that it firmly connects the separate parts of the receptacle to one another under normal conditions, but that it likewise permits the parts to gape apart on reaching a critical excess pressure, and permits the excess pressure in the receptacle to be relieved over a large cross section via the gap forming between the two parts. The bracing is preferably designed such that it permits a separation of the parts of the receptacle but that this is not destroyed on account of the inherent stretching/extension capability, so that the bracing returns to its initial condition again after a suitable pressure compensation in the receptacle.

The parts of the receptacle are preferably braced with tension means, in particular with tie rods. These are arranged between the ends of the receptacle which are distanced normally to the contact surface of the receptacle parts.

Apart from the secure retention of the parts of the receptacle, the tie rods permit a controlled gaping-apart of these parts given an unallowably high excess pressure prevailing in the receptacle, for example of more than 500 bar. For this, the tie rods are arranged such that they are arranged in the direction of the force components of the excess pressure which act normally to the contact/separation surface of the receptacle parts. In this manner, given an excess pressure, the tie rods are extended in a direction parallel to the force which effects the separation of the parts of the receptacle.

Preferably the tie rods are arranged between the ends of the receptacle which are distanced normally to the contact surface of the receptacle parts, since this arrangement permits a largest possible length of the tie rods. This permits a largest possible change in length of the tie rods given an excess pressure loading and accordingly a largest possible gap width between the parts of the receptacle without the yield limit of the tie rods being exceeded.

The sealing means arranged between the receptacle parts, which are preferably designed as soft iron rings, ensure that the receptacle is pressure-tight under normal operating conditions, that is to say below a critical excess pressure, so that the contents of the pressure container may not escape from the receptacle in an undesired manner.

In a preferred embodiment of the device according to the invention, the receptacle comprises a tubular part whose open ends are closed with lids. The tubular part and the lids are connected to tension means which are preferably arranged outside the receptacle and are braced between the lids.

The tubular part of the receptacle is preferably designed in a cylindrical manner and thus is adapted to the shape of the pressure container with which in the usual case it is the case of pressure bottles. The tubular part of the receptacle preferably has a size which permits the storage of pressure containers with a length of up to 1800 mm and a diameter of 300 mm in the receptacle.

The open ends of the tubular part of the receptacle are closed with lids, wherein at least one lid is connected to the tubular part of the receptacle, such that it is releasable from the tubular part by way of an excess pressure prevailing in the receptacle, thus lifts from the seat sealed at the end-face in the direction of the tube axis.

The detachable (releasable) parts of the receptacle are connected by way of tension means, preferably in the form of tie rods which are braced between the lids. For this, a multitude of tension means are arranged such that they extend outside the receptacle parallel to the longitudinal extension of the tubular part of the receptacle.

Advantageously, the tension means are arranged over the whole periphery of the tubular part of the receptacle at a uniform distance. In this manner, the tension means may be uniformly braced over the whole periphery of the contact surfaces between the lid and the tubular part. Furthermore the tension means are uniformly loaded due to an excess pressure in the receptacle. One may muster very high tension forces due to the multitude of tie rods which are possible with this arrangement.

Preferably, a closable opening for introducing and removing the pressure container to be treated is provided in one lid. Pressure containers which are to be emptied may be inserted lengthwise into the receptacle through this opening, and may be withdrawn again after the contents of the pressure container have been led away out of the receptacle. The opening is advantageously dimensioned, such that the pressure container with the largest expected diameter may pass it. The opening is designed such that it may be closed in a pressure-tight manner so that no contents of the pressure container may escape from the receptacle during the opening and emptying of the pressure container.

Preferably, the opening is formed by a recess in the lid, which may be closed in a pressure-tight manner by way of a lockable insert. For this, the locking of the insert in the recess is designed such that it closes the receptacle in a pressure-tight manner under normal operating conditions as well as under the effect of an excess pressure occurring briefly in the inside of the receptacle, which means that the locking opposes an excess pressure with a resistance which is at least larger than that which is to be overcome for activating the excess pressure safety means.

A preferably hydraulically actuated bolt locking for the detachable fastening of the insert into the lid is provided. The bolts are advantageously displaceably arranged in an essentially radial manner between the lid and the insert in this bolt locking since they then produce a high locking force by way of a positive fit. Although a hydraulic actuation of the bolt locking is preferred, this may also be affected pneumatically or in another manner, where appropriate also manually.

Preferably a multitude of bolts connect the lid to the insert, wherein the bolts are movable hydraulically into a locking and unlocking position. The hydraulically actuated embodiment of the bolt locking permits a rapid locking and unlocking of the insert in the lid. The large number of bolts which peripherally lock the insert ensures a force distribution onto the insert which is uniform over the periphery when the receptacle is impinged by pressure.

The bolts at their ends engaging into the insert are advantageously tapered, preferably designed conically. This on closure of the bolt locking permits the insert to be positioned in the radial as well as in the axial direction, in a position in which the insert and the lid close the receptacle in a pressure-tight manner.

Usefully, the insert comprises an opening through which a tool carrier may be led in a pressure-tight manner. For this, at least one sealing element is arranged between the tool carrier and the insert, which on the one hand prevents an escape of the gas which is located in the receptacle after opening the pressure container, and simultaneously also permits axial and/or rotational movements of the tool carrier in the opening.

A drilling machine is advantageously provided as an opening means, wherein the drilling machine comprises a drive shaft led through the opening of the insert, a tool chuck arranged on the drive shaft in the receptacle, and a drive arranged outside the receptacle. Preferably a drill, in particular a drill with a diameter of for example 10 mm and with a flattened shank is provided as a tool, with which the pressure container may be drilled open at its end which is distanced to the valve. All common drive means for producing a rotational movement are conceivable as a drive, for example commercially available drilling machines may also be applied as a drive.

In a further preferred embodiment of the invention, a preferably hydraulically actuated pin is provided as an opening means. The pin is arranged in the inside of the receptacle on a rod guided through the opening of the insert. The hydraulics are connected to the push rod outside the receptacle. The rod which is guided in an axially displaceable and sealing manner in the insert, at its end lying on the outside, is impinged by a hydraulic cylinder which is supported on a stand on the lid side. The hydraulic cylinder is arranged such that on extending its piston rod, it pushes the push rod with the pin connected thereto against the base of the pressure container arranged in the receptacle, so that the pin pierces the base, and the contents of the pressure container may escape into the receptacle.

Usefully a slide (carriage) is connected to that side of the insert which faces the inside of the receptacle and this slide serves for mounting, handling and fixing the pressure container.

The slide together with the insert is formed in a traveling manner in the longitudinal direction of the receptacle. Thus, the slide may be moved through the opening of the lid into a position in which it is located to a greater extent outside the receptacle. In this position, the slide may be charged/loaded with, or emptied of a pressure container. Lying on the slide, the pressure container may be fixed such that it has a distance to the opening tool which is useful with regard to the opening, and in this position may neither move in the longitudinal direction of the carriage nor transversely to this longitudinal direction. This fixation may be effected, for example, by way of wedge elements and/or belts or other clamping elements which are connected to the slide.

The insert and the slide connected thereto is designed preferably in a hydraulically traveling manner in the longitudinal direction of the container. For this a pressure cylinder which is arranged parallel to the slide is coupled to the insert. The insert, with the slide may be moved into a position outside the receptacle by way of extending the pressure cylinder. After loading the slide with a pressure container, the slide may again be moved into the receptacle by way of retracting the hydraulic piston. The hydraulic traveling ability of the slide is particularly advantageous, since the pressure containers to be emptied may have a very large weight.

According to a further formation of the invention, it is envisaged for the complete receptacle with the associated handling units for the pressure container to be mounted in a supporting frame which is preferably designed in a traveling manner, thus for example may form part of a vehicle or a vehicle trailer. A three-point mounting is useful for the transport, wherein a support of the receptacle at both ends is useful in order to keep the dynamic moment loading as low as possible. The container may be mounted within the supporting frame in a spring/resilient manner and/or the supporting frame itself may be spring mounted.

The spring mounting of the receptacle is in the position of damping impacts which may occur on operation, on lowering and on transport of the device. Furthermore, the supporting frame permits the device to be received at the supporting frame, for example by a fork-lift truck, without the danger existing of a damage of the receptacle and the hydraulics which are connected thereto.

The receptacle is usefully mounted in a pivotable manner in the supporting frame and in a manner such that the receptacle may be pivoted transversely to its vertical axis in the vertical direction. Preferably hydraulically acting means, for example hydraulic cylinders are envisaged for pivoting the receptacle. The pivotable mounting is usefully effected in the region of the end of the receptacle at which the opening is provided for loading and unloading. The receptacle is formed particularly heavily in this region on account of the auxiliary units and the locking, which also engage here, which is why it is favorable to locate the pivot arbor in this region. Such a pivotably mounted receptacle may be pivoted for example from a horizontal position or one which is slanted slightly upwards, in which the loading and unloading is effected, at a given time into a roughly 90° position, so that the contents located in the pressure container may then escape out of the pressure container through the opening created on the base side, where it is usefully led away via suitable conduits on the base side, so that the pressure container and receptacle may be completely emptied in this position.

For this purpose, it is useful to provide an outlet on the region of the receptacle which is then arranged at the bottom, or on the lid of the receptacle which is then arranged on the bottom, and this fluid may then be led away via this valve.

The pivoting of the receptacle in the supporting frame may be effected manually, preferably however hydraulically acting means, for example a hydraulically actuated pivot lever is provided for pivoting the receptacle.

At least one, preferably however several, conduit lead-through which may be closed in a pressure-tight manner is provided on the receptacle. These conduit lead-throughs in particular are envisaged for leading away the contents of the pressure container out of the receptacle and for safely disposing of these contents. Usefully, a multitude of conduit lead-throughs are provided so that it is ensured that the contents located in the receptacle may be reliably led away, even with a possible blockage of a conduit opening. A blockage of these conduit lead-throughs may not be ruled out when opening in particular very old pressure containers if for example larger pressure container parts break loose on drilling or pressing open and then block an opening. An adequate free conduit cross section for leading away the contents of the container always remains due to the multitude of conduit lead-throughs.

Furthermore, flushing gases or flushing fluid may be led into and out of the receptacle via these conduit lead-throughs so that the handling of critical substances may also be ensured in a safe manner by way of being able to remove residues of these substance from the receptacle by way of a suitable suctioning away and flushing. It is furthermore advantageous if a vacuum pump is connected to at least one conduit lead-through, with which the receptacle may be evacuated before or after opening the pressure container. The emptying of the pressure container into the receptacle may be accelerated or a complete emptying of the pressure container is ensured by way of the production of a vacuum.

An icing-up and blockages which this entails may occur at the opening location, particularly on emptying gas-filled pressure containers due to the exiting gas. In order to prevent this, the receptacle is usefully equipped with a heating which is arranged within or preferably outside the receptacle. The heating may designed in the form of an electrical resistance heating but also, and this is preferred, by way of heating tubes led on the outer side of the receptacle, through which a heating means, for example oil or water flows.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
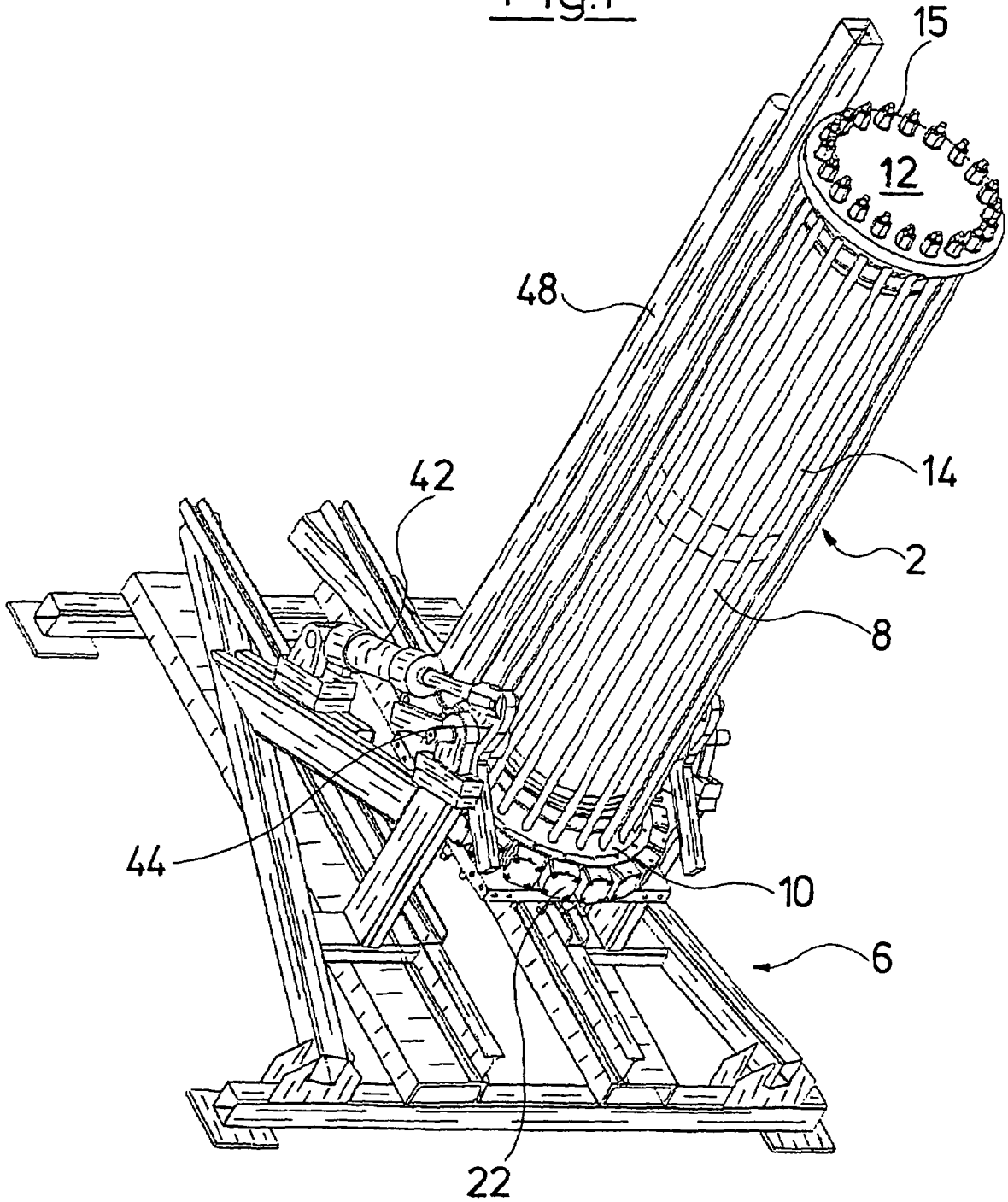
FIG. 1 is a perspective view of the device according to the invention, in the pivoted-open condition.
Figure 2:
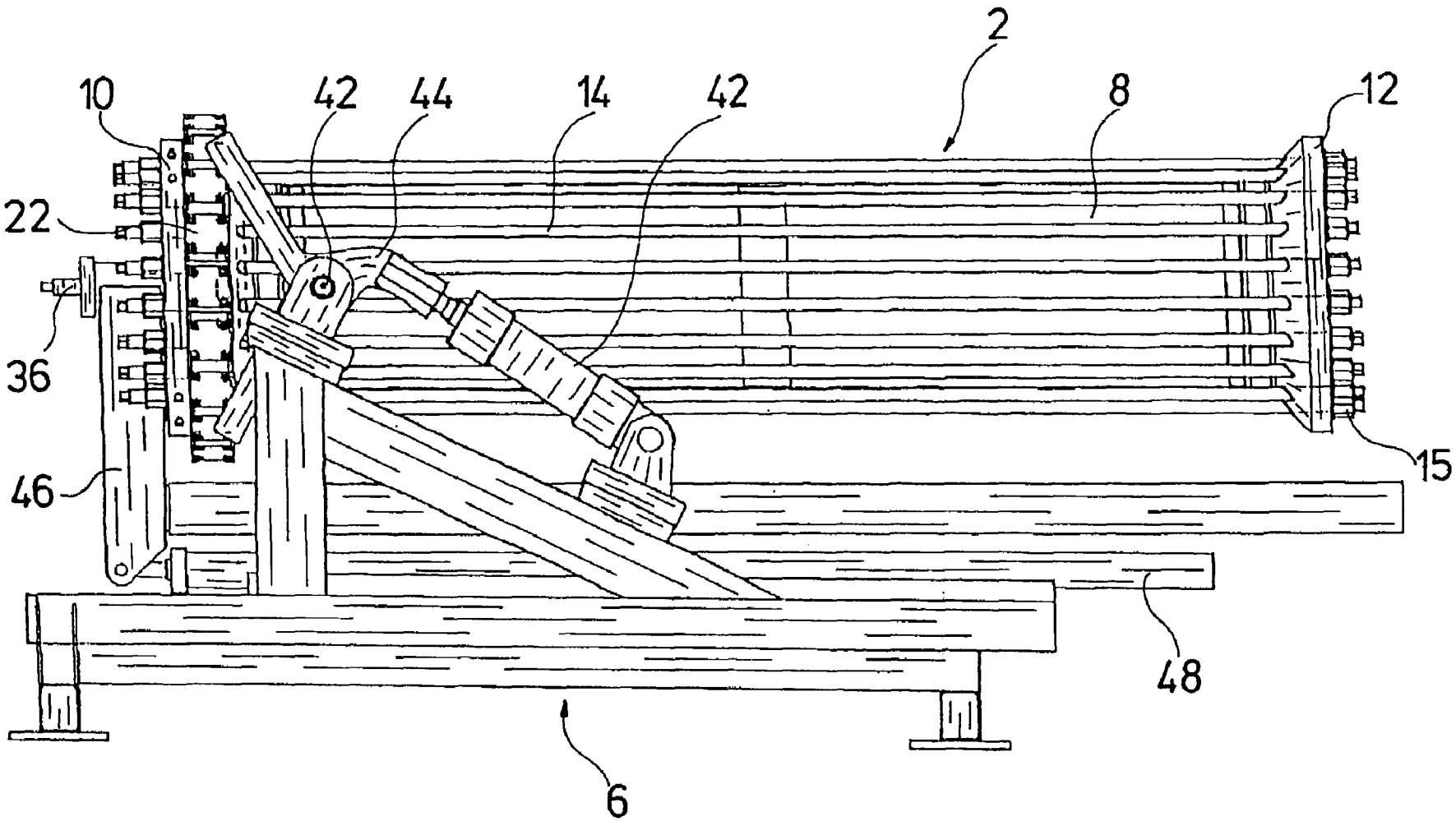
FIG. 2 is a lateral view of the device of FIG. 1 in the lowered condition.

The device for emptying a pressure container, which is represented in the Figures, comprises a receptacle 2 for accommodating a pressure container 4 which is connected to a supporting frame 6.

The receptacle 2 contains a tubular base body 8 whose ends are designed in an open manner. A first lid 10 and a second lid 12 are arranged at the open end of the base body 8 such that they close the base body 8. With this, the end-face of the lid 10 as well as the end-face of the lid 12 are larger than the cross sectional surface of the base body 8. Both lids 10 and 12 are in each case are arranged concentrically to the opening surfaces of the base body 8. In this manner a peripheral outer region of the lids 10 and 12 projects beyond the peripheral surface of the base body 8.

A multitude of openings are arranged in this region of the lids 10 and 12 which projects beyond the base body 8, the openings being distanced to one another and distanced to the peripheral surface of the base body.

A multitude of tie rods 14 are arranged along the outer wall of the base body 8. These tie rods 14 extend parallel to the longitudinal axis of the base body 8, wherein their end region provided with a thread in each case is led through an opening of the first lid 10 as well as through an opening of the second lid 12 which lies opposite this opening. Nuts 15 are screwed on the ends of the tie rods 14 such that they engage on the sides of the lids 10 and 12 which are distanced to the base body 8, and brace these lids 10 and 12 with the base body 8.

In each case a soft iron ring 16 is arranged between the contact surfaces of the base body 8 to the first lid 10 and to the second lid 12, for closing the receptacle 2 in a pressure-tight manner.

The first lid 10 comprises a circular opening 18. The opening 18 is designed concentrically to the lid 10, and with a diameter which corresponds roughly to the inner diameter of the base body 8. An essentially cylindrical insert 20 is admitted into the opening 18 of the first lid 10. This insert 20 is detachably connected to the lid 10 via a multitude of connection elements 22.

With regard to the connection elements 22 it is the case of hydraulically traveling bolts 24. For connecting the connection elements 22, the lid 10 comprises a multitude of radial recesses 26 which break through the lid 10 in the radial direction from the peripheral surface to the opening 18.

The insert 20 also comprises a corresponding number of radially aligned recesses 28, corresponding to the recesses 26 of the lid 10. The cross sectional dimensions of each recess 26 and recess 28 are dimensioned such that the bolts may be guided in them essentially without play. The end regions of the bolts 24 which face the insert 20 are designed in a conical manner. Accordingly, the recess 28 also has a conical shape in a manner such that its diameter tapers in the direction of the longitudinal axis of the receptacle 2.

Figure 5:
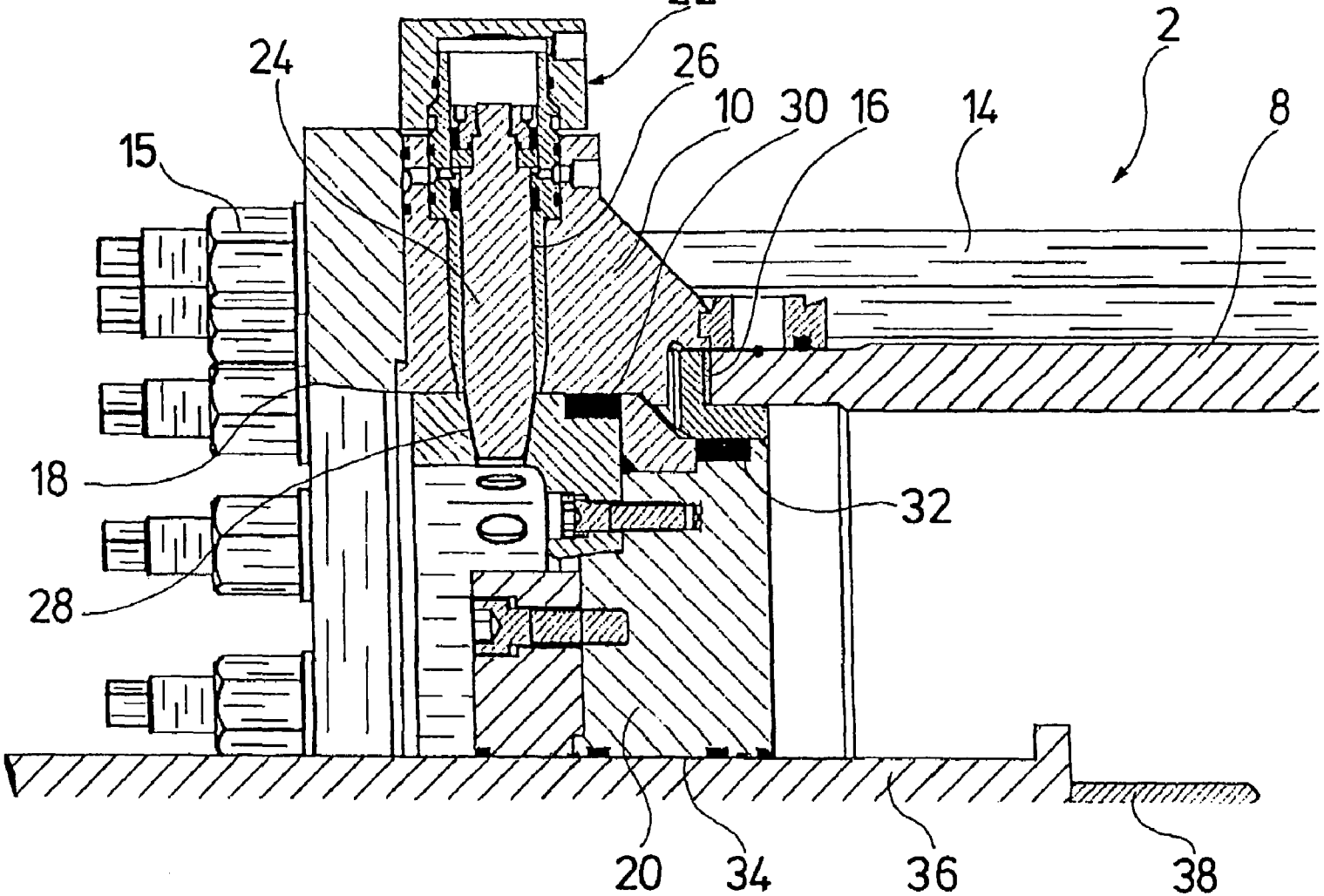
FIG. 5 is a sectioned region of that end of the receptacle which is on the tool side.

It is evident from FIG. 5 that in the closed condition of the first lid 10, the conical end of the bolts 24 engages into the recesses 28 which are likewise formed in a conical manner. The conical design of the bolts 24 and the recesses 28 permits the insert 20 to be automatically aligned in an exact manner in the axial as well as radial direction by way of retracting the bolts 24 into the recesses 28.

The sealing elements 30 and 32 which are arranged between the contact surfaces of the lid 10 and of the insert 20 located therein seal the insert 20 with respect to the lid 10 in a pressure-tight manner.

The insert 20 in its center comprises an opening 34. A tool holder 36 is guided through this opening 34 in the direction of the longitudinal axis of the receptacle 2 such that it is may be moved in the axial direction as well as rotated about its longitudinal axis. Sealing means which seal the tool holder 36 with respect to the opening 34 in a pressure-tight manner are likewise provided between the tool holder 36 and the wall of the opening 34.

An opening tool in the form of a drill 38 for opening the pressure container 4 located in the receptacle 2 is arranged at that end of the tool holder 36 which is arranged in the inside of the receptacle 2. A drive for the tool holder 36 and the drill 38 which is fastened thereto, the drive not being shown in the figures, is provided at the second end of the tool holder 36 which is located outside the receptacle 2.

Alternatively, one may provide a push pin instead of a drilling tool, and the tool carrier 36 then forms an axially displaceable rod on whose end which is in the receptacle the push pin is attached, and on whose outer end a hydraulic cylinder is attached, whose supporting frame is firmly connected to the lid 10 and is thus supported on this.

On the inner side of the insert 20, that is to say on its side which faces the inside of the receptacle 2, a slide 40 for accommodating a pressure container 4 is connected onto the insert 20 via a connection which is not shown in the drawing. The slide 40 has the shape of an extended shell-like cylinder segment and is aligned in the direction of the longitudinal extension of the container base body 8. The insert 20, after releasing the connection elements 22 may be traveled together with the slide 40 out of the receptacle 2, so that the slide 40 may be loaded with a pressure container 4 outside the receptacle 2. Fastening means are provided on the slide 40, which are not shown in the Figures, in order to fix the pressure container 4 in the direction of its longitudinal axis and also transversely to 25 this longitudinal axis.

Figure 3:
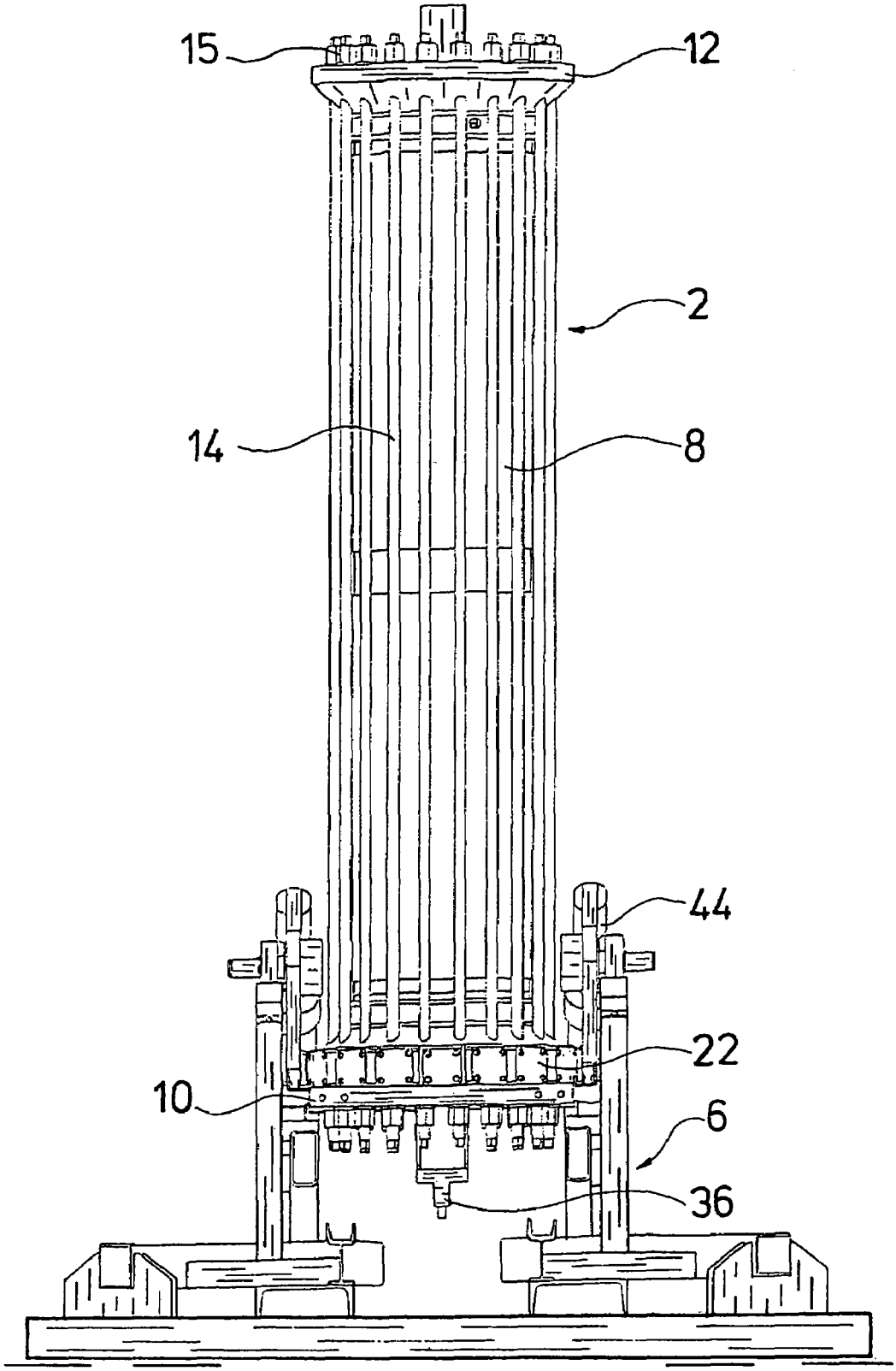
FIG. 3 is a front view of the device of FIG. 1.
Figure 4:
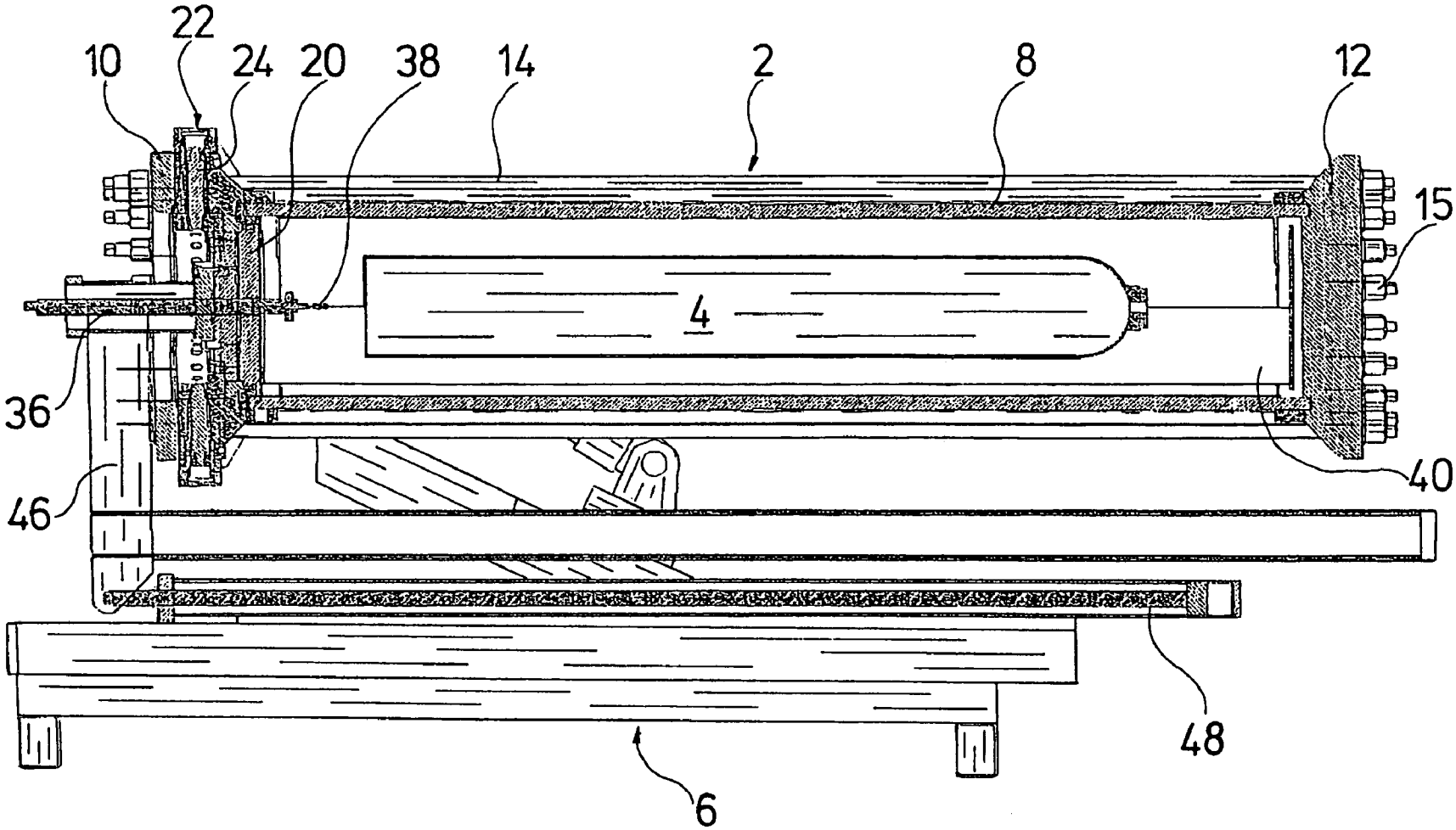
FIG. 4 is a longitudinal section of the device shown in FIG. 2.

The receptacle 2 is connected to the supporting frame 6 via the first lid 10 such that the receptacle 2 may be pivoted transversely to its longitudinal axis by way of a hydraulically actuated pressure cylinder 42. For pivoting the receptacle 2, two levers 44 which are pivotably mounted on the supporting frame 6 are arranged on the lid 10 of the receptacle in a diametrically distanced manner. The pressure cylinder 42 is connected to one of the levers 44 between that end of the second lever arm which is distanced to the lid 10, and the supporting frame 6. The receptacle may be brought into the vertical position represented in FIGS. 1 and 3 by way of extending the pressure cylinder 42 by way of hydraulics which are not shown.

In this position, any fluid contents of the receptacle 2 may be led out of the receptacle 2 through discharge conduits arranged in the region of the first lid 10. These discharge conduits, just as the connection of the lid 10 to the supporting frame 6, have not been shown in the Figures for the purpose of an improved overview.

One end of a support 46 is connected on the outwardly directed side of the insert 20 arranged in the lid 10 in a manner such that the support extends transversely to the longitudinal extension of the receptacle 2, and the second end of the support 46 is distanced outwards to the peripheral surface of the receptacle 2. A further, hydraulically actuated pressure cylinder 48 engages on this second end of the support 46.

This pressure cylinder 48 is aligned perpendicularly to the support 46 and parallel to the longitudinal extension of the receptacle 2 and of the slide 40 located therein. Furthermore the pressure cylinder 48 with the receptacle 2 is pivotable in the vertical direction transversely to the longitudinal axis of the receptacle 2. The pressure cylinder 48 serves for extending and retracting the slide 40 and the insert 20 connected thereto.

If the pressure cylinder 48 is hydraulically extended after unlocking the connection elements 22, the insert 20 and the carriage 40 travel into a position outside the receptacle 2, in which the slide 40 may be loaded with a pressure container 4 or relieved of this.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A device for emptying a pressure container (4), comprising a receptacle (2), the receptacle (2) having ends and being designed of at least two parts, the two parts of the receptacle (2) being braced to one another between the ends of the receptacle for forming an excess pressure safety means, the receptacle capable of being closed in a pressure-tight manner for accommodating the pressure container (4), means for opening (38) the pressure container (4) located in the receptacle (2), means for leading away the container contents.

2. The device according to claim 1, wherein the parts of the receptacle (2) are braced with tie rods (14) which are arranged between the ends of the receptacle (2) which are distanced normally to the contact surface of the receptacle parts, wherein a soft iron ring (16) is arranged between the receptacle parts.

3. The device according to claim 1, wherein the receptacle (2) comprises a tubular part (8) whose open ends are closed with lids (10, 12), wherein the tubular part (8) and the lids (10, 12) are connected with tension means (14) which are arranged outside the receptacle (2) and which are braced between the lids (10, 12).

4. The device according to claim 1, wherein a closable opening (18) for introducing and removing the pressure container (4) is provided in one lid (10).

5. The device according to claim 4, wherein the opening (18) is formed by a recess (18) in the lid (10), which may be closed in a pressure-tight manner by way of a lockable insert (20).

6. The device according to claim 5, wherein a hydraulically actuated bolt locking (22) is provided for the releasable fastening of the insert (20) in the lid (10), wherein the bolts (24) are displaceably arranged essentially radially between the lid (10) and the insert (20).

7. The device according to claim 5, wherein the insert (20) comprises an opening (34) for leading through of a tool carrier (36) in a pressure-tight manner.

8. The device according to claim 7, wherein a drilling machine is provided as an opening means, wherein the drilling machine comprises a drive shaft (36) led through the opening (34) of the insert (20), a tool chuck arranged on the drive shaft in the receptacle (2), and a drive arranged outside the receptacle (2).

9. The device according to claim 7, wherein a preferably hydraulically actuated pin is provided as an opening means, wherein the pin is arranged in the inside of the receptacle (2) on a push rod guided through the opening (34) of the insert (20), and the hydraulics are connected to the push rod outside the receptacle (2).

10. The device according to claim 5, wherein a slide (40) for mounting, handling and fixing the pressure container (4) is connected on that side of the insert (20) which faces the inside of the receptacle (2).

11. The device according to claim 10, wherein the insert (20) and the slide (40) connected thereto are designed traveling in the longitudinal direction of the receptacle (2), preferably in a hydraulic manner.

12. The device according to claim 1, wherein the receptacle (2) is mounted in a preferably traveling supporting frame (6).

13. The device according to claim 1, wherein the receptacle (2) is pivotally mounted in the supporting frame (6) in a manner such that the receptacle (2) may be pivoted transversely to its longitudinal axis in the vertical direction, wherein hydraulically acting means (42) are provided for pivoting the receptacle (2) in the supporting frame (6).

14. The device according to claim 1, wherein at least one conduit lead-through capable of being closed in a pressure-tight manner is provided on the receptacle (2).

15. The device according to claim 1, wherein the receptacle (2) is designed such that it may be heated.

* * * * *